US009423740B2

(12) United States Patent
Nawa

(10) Patent No.: US 9,423,740 B2
(45) Date of Patent: Aug. 23, 2016

(54) IMAGE FORMING APPARATUS WITH FIXING PORTION HAVING EXCITING COIL CONFIGURED TO CAUSE ROTATABLE MEMBER TO GENERATE HEAT BY ELECTROMAGNETIC INDUCTION HEATING

(71) Applicant: CANON KABUSHIKI KAISHA, Tokyo (JP)

(72) Inventor: Masahiro Nawa, Kumamoto (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 13/948,281

(22) Filed: Jul. 23, 2013

(65) Prior Publication Data

US 2014/0037309 A1 Feb. 6, 2014

(30) Foreign Application Priority Data

Jul. 31, 2012 (JP) ..... 2012-169519

(51) Int. Cl.
*G03G 15/20* (2006.01)

(52) U.S. Cl.
CPC ..... *G03G 15/2082* (2013.01); *G03G 15/2042* (2013.01); *G03G 15/2053* (2013.01)

(58) Field of Classification Search
CPC ..... G03G 15/2042; G03G 15/2082
USPC ..... 399/45, 334
See application file for complete search history.

(56) References Cited

U.S. PATENT DOCUMENTS

2006/0086719 A1* 4/2006 Suzuki et al.
2006/0147221 A1* 7/2006 Asakura et al.
2007/0201916 A1 8/2007 Ueno
2009/0252519 A1 10/2009 Yamagata
2010/0067929 A1 3/2010 Seki (Continued)

FOREIGN PATENT DOCUMENTS

JP 06-175496 A 6/1994
JP 08-184921 A 7/1996

(Continued)

OTHER PUBLICATIONS

U.S. Appl. No. 13/946,336, Masahiro Nawa, Keisuke Mogi, filed Jul. 19, 2013.

(Continued)

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image forming apparatus includes (i) a feeding portion; (ii) an image forming portion; and (iii) a fixing portion. The fixing portion includes: (iii-i) a rotatable member; (iii-ii) an exciting coil configured to cause the rotatable member to generate heat by electromagnetic induction heating; (iii-iii) a magnetic flux suppressing member configured to suppress a part of magnetic flux acting from the exciting coil to the rotatable member; and (iii-iv) a motor for moving the magnetic flux suppressing member depending on a width size of the sheet; and (iv) a controller configured to variably control a feeding interval of the sheet by the feeding portion so that a number of times of movement per unit time of the magnetic flux suppressing member is not more than a predetermined value when image formation of a plurality of sheets different in width size is continuously effected.

14 Claims, 10 Drawing Sheets

(56) References Cited

U.S. PATENT DOCUMENTS

| | | | |
|---|---|---|---|
| 2010/0129099 | A1 | 5/2010 | Sugimoto |
| 2012/0328338 | A1 | 12/2012 | Nawa et al. |
| 2012/0328342 | A1 | 12/2012 | Takematsu et al. |
| 2013/0094887 | A1 | 4/2013 | Nawa et al. |

FOREIGN PATENT DOCUMENTS

| | | | |
|---|---|---|---|
| JP | 2004-265669 | A | 9/2004 |
| JP | 2005-208624 | A | 8/2005 |
| JP | 2007-226137 | A | 9/2007 |
| JP | 2008-012850 | A | 1/2008 |
| JP | 2009-251179 | A | 10/2009 |
| JP | 2010-66583 | A | 3/2010 |
| JP | 2010-152321 | A | 7/2010 |
| JP | 2010-217663 | A | 9/2010 |

OTHER PUBLICATIONS

Japanese Office Action issued in corresponding Japanese Application No. 2012-169519 mailed May 10, 2016.

* cited by examiner

IMAGE FORMING APPARATUS WITH FIXING PORTION HAVING EXCITING COIL CONFIGURED TO CAUSE ROTATABLE MEMBER TO GENERATE HEAT BY ELECTROMAGNETIC INDUCTION HEATING

FIELD OF THE INVENTION AND RELATED ART

The present invention relates to an image forming apparatus for forming a toner image on a sheet, and specifically relates to an image forming apparatus, such as a copying machine, a printer, a facsimile machine or a multi-function machine having a plurality of functions of these machines, for effecting image formation in, e.g., an electrophotographic type, electrostatic recording type, or magnetic recording type.

In the image forming apparatus, an unfixed toner image formed on a recording material (sheet) is fixed by being heated and pressed.

In a fixing device used in the image forming apparatus, a method in which a fixing member (rotatable member) is heated by using an electromagnetic-induction-heating type has been proposed. In this method, a heat generating source can be placed very near to a toner, and therefore compared with a conventional heating type using a halogen lamp, the above-proposed type is characterized in that the time required until the surface temperature of the fixing roller during actuation of the fixing device reaches a target temperature can be shortened. Further, the above-proposed type is also characterized in that a heat-conduction path from the heat generating source to the toner is short and simple, and therefore heat efficiency is high.

However, in the fixing device as described above, when small-sized recording materials are continuously subjected to fixing in a large volume, heat is conducted to the recording material at a place (passing portion) where the fixing roller surface contacts the recording material, and thus the recording material is conveyed, whereas there is no heat-imparting portion at a non-contact place (non-passing portion), and therefore the heat is accumulated to cause a large temperature difference in some cases. Incidentally, the passing portion is maintained at a predetermined target temperature, and therefore the non-passing portion is excessively increased in temperature. This phenomenon is called a non-passing portion temperature rise.

In order to address the non-passing portion temperature rise, in an apparatus described in Japanese Laid-Open Patent Application (JP-A) 2004-265669, a magnetic flux suppressing member for suppressing passing of magnetic flux is provided, and is moved by a motor, depending on the width size of a recording material. As a result, the non-passing portion temperature rise is alleviated.

However, in the case where such a method is employed, when the width size of the recording material is frequently changed, the magnetic flux suppressing member is required to be moved frequently depending on the change in width size of the recording material, and thus the load exerted on the motor becomes large, so that there is a fear that the motor causes a self-temperature rise.

SUMMARY OF THE INVENTION

A principal object of the present invention is to provide an image forming apparatus capable of alleviating a load exerted on a motor.

Another object of the present invention is to provide an image forming apparatus capable of suppressing the self-temperature rise of the motor.

According to an aspect of the present invention, there is provided an image forming apparatus comprising: (i) a feeding portion configured to feed a sheet; (ii) an image forming portion configured to form a toner image on the sheet fed by the feeding portion; and (iii) a fixing portion configured to fix the toner image, formed by the image forming portion, on the sheet by heat and pressure. The fixing portion comprises: (iii-i) a rotatable member; (iii-ii) an exciting coil configured to cause the rotatable member to generate heat by electromagnetic induction heating; (iii-iii) a magnetic flux suppressing member configured to suppress a part of the magnetic flux acting from the exciting coil to the rotatable member; and (iii-iv) a motor for moving the magnetic flux suppressing member depending on the width size of the sheet; and (iv) a controller configured to variably control the feeding interval of the sheet by the feeding portion so that the number of times of movement per unit time of the magnetic flux suppressing member is not more than a predetermined value when image formation of a plurality of sheets different in width size is continuously effected.

According to another aspect of the present invention, there is provided an image forming apparatus comprising: (i) a feeding portion configured to feed a sheet; (ii) an image forming portion configured to form a toner image on the sheet fed by the feeding portion; and (iii) a fixing portion configured to fix the toner image, formed by the image forming portion, on the sheet by heat and pressure. The fixing portion comprises: (iii-i) a rotatable member; (iii-ii) an exciting coil configured to cause the rotatable member to generate heat by electromagnetic induction heating; (iii-iii) a magnetic flux suppressing member configured to suppress a part of magnetic flux acting from the exciting coil to the rotatable member; and (iii-iv) a motor for moving the magnetic flux suppressing member depending on the width size of the sheet; and (iv) a controller configured to variably control the feeding interval of the sheet by the feeding portion so that the value of a current per unit time to be supplied to the motor is not more than a predetermined value when image formation of a plurality of sheets different in width size is continuously effected.

According to a further aspect of the present invention, there is provided an image forming apparatus comprising: (i) a feeding portion configured to feed a sheet; (ii) an image forming portion configured to form a toner image on the sheet fed by the feeding portion; and (iii) a fixing portion configured to fix the toner image, formed on the sheet by the image forming portion, by heat and pressure. The fixing portion comprises: (iii-i) a rotatable member; (iii-ii) a shutter configured to suppress a temperature rise in a part of a region of the rotatable member with respect to a longitudinal direction of the rotatable member; and (iii-iii) a motor for moving the shutter depending on the width size of the sheet; and (iv) a controller configured to control the feeding interval of the sheet by the feeding portion so that the number of times of movement per unit time of the shutter is not more than a predetermined value when image formation of a plurality of sheets different in width size is continuously effected.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) and (b) of FIG. 1 are exploded views of constituent members of a fixing device (image heating apparatus) in Embodiment 1, wherein (a) shows a state in which each of left and right magnetic flux adjusting members is located in an initial position, and (b) shows a state in which each of the left and right magnetic flux adjusting members is moved to an adjusting position corresponding to a position of a minimum size width recording material during sheet passing.

DESCRIPTION OF THE PREFERRED EMBODIMENTS

Hereinbelow, embodiments of the present invention will be described, but although the embodiments are an example of best mode in the present invention, the present invention is not limited to these embodiments.

Embodiment 1

<Image Forming Apparatus>

Figure 2:
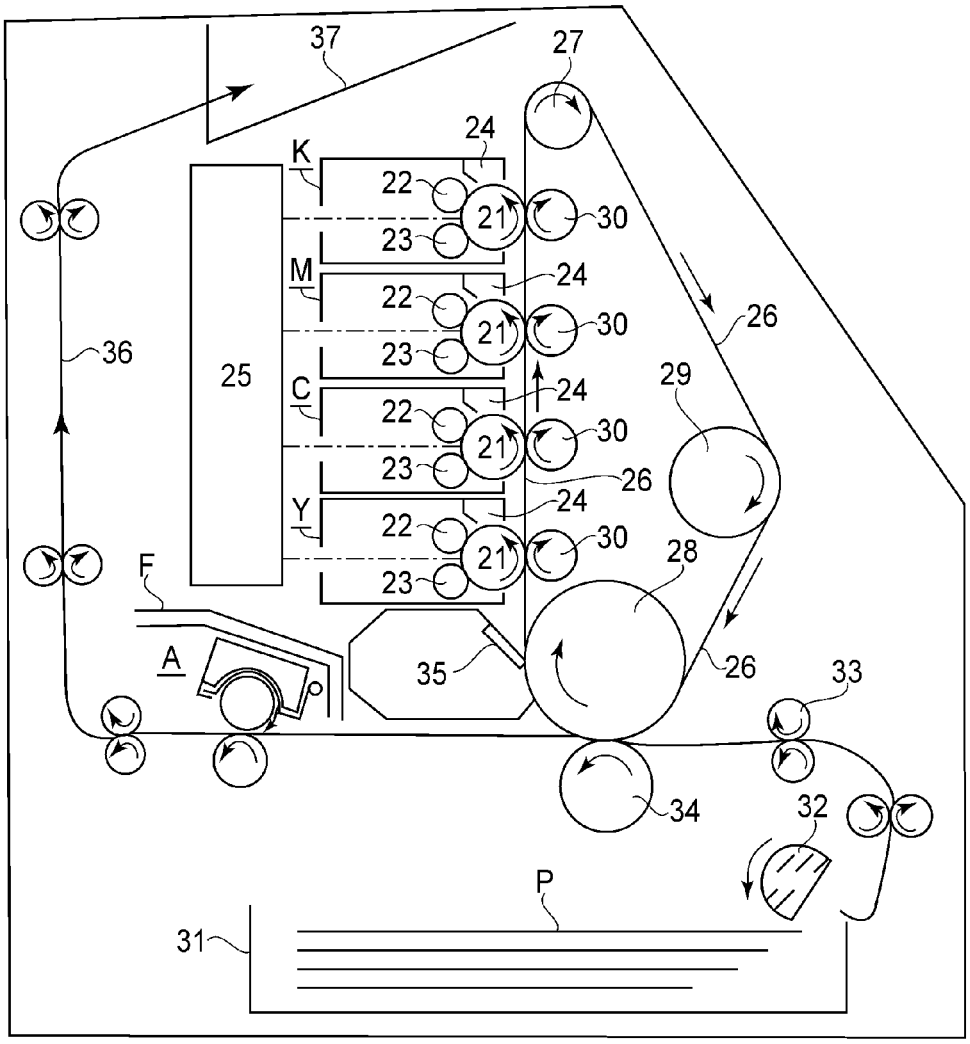
FIG. 2 is a sectional illustration of an example of an image forming apparatus in Embodiment 1.

FIG. 2 is a structural illustration of an example of an image forming apparatus, according to the present invention, in which an image heating apparatus of an electromagnetic induction heating type is mounted as a fixing device A. This image forming apparatus is a color image forming apparatus using an electrophotographic type of image forming operation.

As image forming portions for forming toner images on the recording material (sheet), in this embodiment, Y, C, M and K represent four image forming portions for forming color toner images of yellow (Y), cyan (C), magenta (M) and black (K), respectively, and are arranged in this order from a lower portion to an upper portion. Each of the image forming portions Y, C, M, and K includes an electrophotographic photosensitive drum 21, a charging device 22, a developing device 23, a cleaning device 24, and the like.

In the developing device 23 of the image forming portions Y, C, M and K, toners of Y, C, M and K are accommodated.

Each drum 21 is rotationally driven in the counterclockwise direction of an arrow at a predetermined peripheral speed. An optical system 25 for forming an electrostatic latent image by subjecting each of the drums 21 to exposure to light is provided correspondingly to the image forming portions Y, C, M and K for the above-described four colors. As the optical system, 25, a laser scanning exposure optical system is used.

At each of the image forming portions, Y, C, M and K, the drum 21 electrically charged uniformly by the charging device 22 is subjected to scanning exposure on the basis of image data by the optical system 25, so that an electrostatic latent image corresponding to a scanning exposure image pattern is formed on the drum surface.

The resultant electrostatic latent images are developed into the toner images by the developing devices 23. That is, a yellow (Y) toner image is formed on the drum 21 for the yellow image forming portion Y and a cyan (C) toner image is formed on the drum 21 for the cyan image forming portion C. Further, a magenta (M) toner image is formed on the drum 21 for the magenta image forming portion M and a black (K) toner image is formed on the drum 21 for the image forming portion K.

The above-described color toner images formed on the drums 21 for the respective image forming portions Y, C, M and K are successively primary-transferred superposedly onto an intermediary transfer member 26, rotated in synchronism with and at the substantially same speed as rotation of the respective drums 21, in a predetermined alignment state. As a result, unfixed full-color toner images are synthetically formed on the intermediary transfer member 26.

In this embodiment, as the intermediary transfer member functioning as an image forming portion for forming the toner image on the recording material (sheet), an endless intermediary transfer belt is used. The belt 26 is wound and stretched around three rollers consisting of a driving roller 27, a secondary transfer opposite roller 28, and a tension roller 29. Further, the belt 26 is driven by the driving roller 27 in the clockwise direction of an arrow at the substantially same peripheral speed as that of the drum 21 to be circulated and moved.

As a primary transfer means for transferring the toner image from the drum 21 for each of the image forming portions Y, C, M and K onto the belt 26, a primary transfer roller 30 is used. To the primary transfer roller 30, a primary transfer bias of a polarity opposite to that of the toner is applied from an unshown bias power source. As a result, the toner image is primary-transferred from the drum 21 for each of the image forming portions Y, C, M and K onto the belt 26. After the primary-transfer from the drum 21 onto the belt 26 at each of the image forming portions Y, C, M and K, toner remaining on the photosensitive drum 21 as transfer residual toner is removed by the cleaning device 24.

The above-described steps are performed with respect to the respective colors of Y, C, M and K in synchronism with the rotation of the belt 26 to successively form superposedly the primary-transferred toner images for the respective colors on the belt 26. Incidentally, during image formation for only a single color (in a single color mode), the above-described steps are performed for only an objective color.

On the other hand, the recording material (sheet) P in a recording material cassette 31 is separated and fed one by one by a feeding roller 32 functioning as a feeding portion for feeding the recording material (sheet) toward the image forming portion. The fed recording material P is conveyed, with predetermined timing by registration rollers 33 functioning as a conveying portion, to a secondary transfer nip, which is a press-contact portion between a secondary transfer roller 34 and a belt 26 portion extended and wound around the secondary transfer opposite roller 28.

The primary-transferred synthetic toner images formed on the belt 26 are simultaneously transferred onto the recording material P by a bias, of a polarity opposite to that of the toner, applied from an unshown bias power source to the secondary transfer roller 34. After the secondary transfer, secondary transfer residual toner remaining on the belt 26 is removed by an intermediary transfer belt cleaning device 35.

The toner images secondary-transferred onto the recording material P are heat-fixed (fusing and color mixing fixing) on the recording paper P by a fixing device A as the image heating apparatus, so that the recording material P is sent, as a full-color print, to a sheet discharge tray 37 through a sheet discharge path 36.

<Fixing Device A>

In the following description, with respect to the fixing device (fixing portion) A or members constituting the fixing device A, a longitudinal direction or a widthwise direction refers to a direction parallel to a direction perpendicular to a recording material conveyance direction a (FIG. 5) in a plane of a recording material conveyance path. Further, a short direction refers to a direction parallel to the recording material conveyance direction a. With respect to the fixing device A, a front surface refers to a surface as seen from a recording material entrance side with respect to the recording material conveyance direction, and a rear surface is a surface (a recording paper exit side) opposite from the front surface. The left (side) and the right (side) refer to left (side) and right (side) as seen from the front surface side of the fixing device A. An upstream side and a downstream side refer to an upstream side and a downstream side with respect to the recording material conveyance direction a. Up and down are up and down with respect to a direction of the gravitation.

Figure 3:
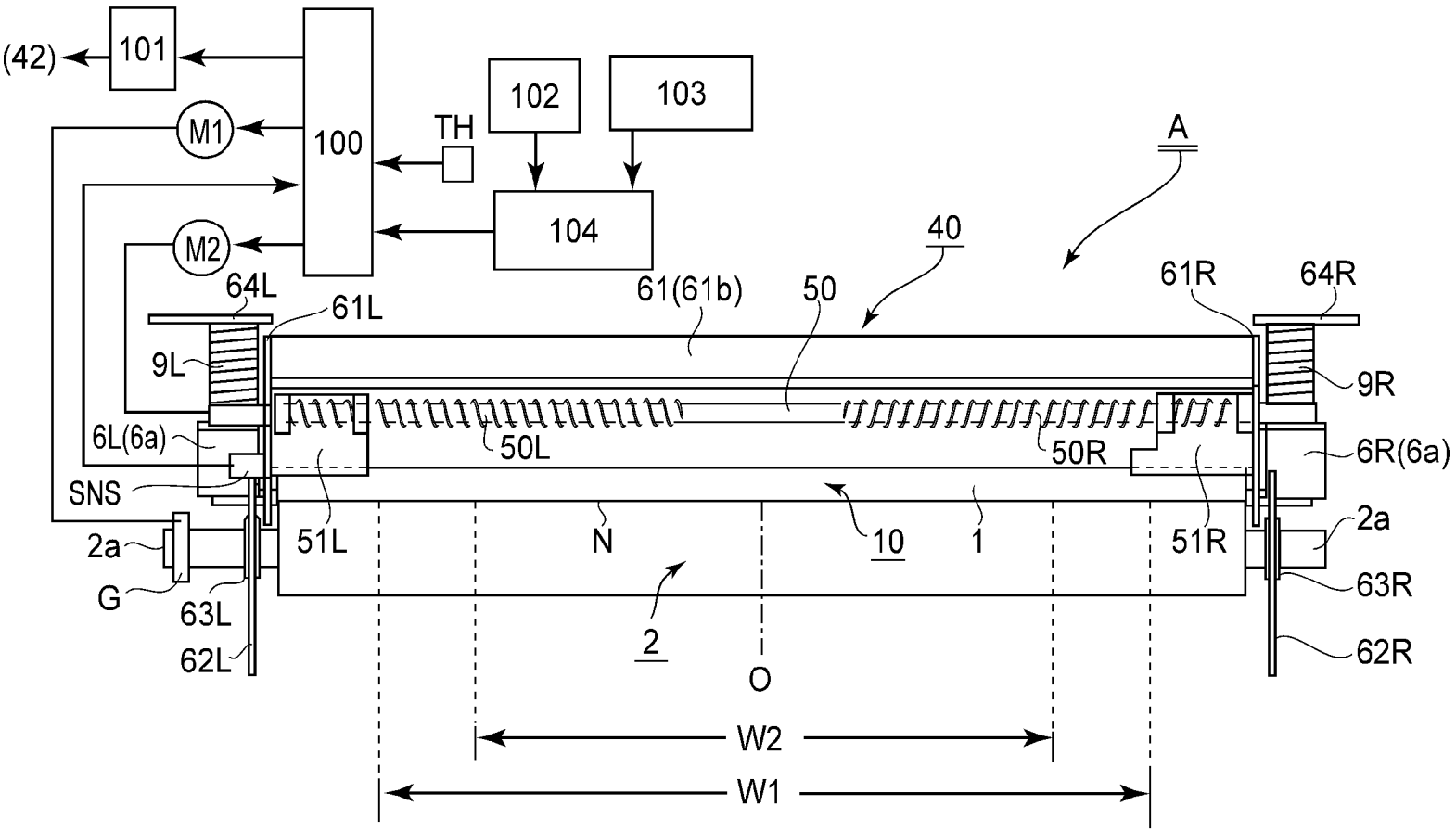
FIG. 3 is a schematic front view of a principal part of the fixing device and is a block diagram of a control system in Embodiment 1.
Figure 4:
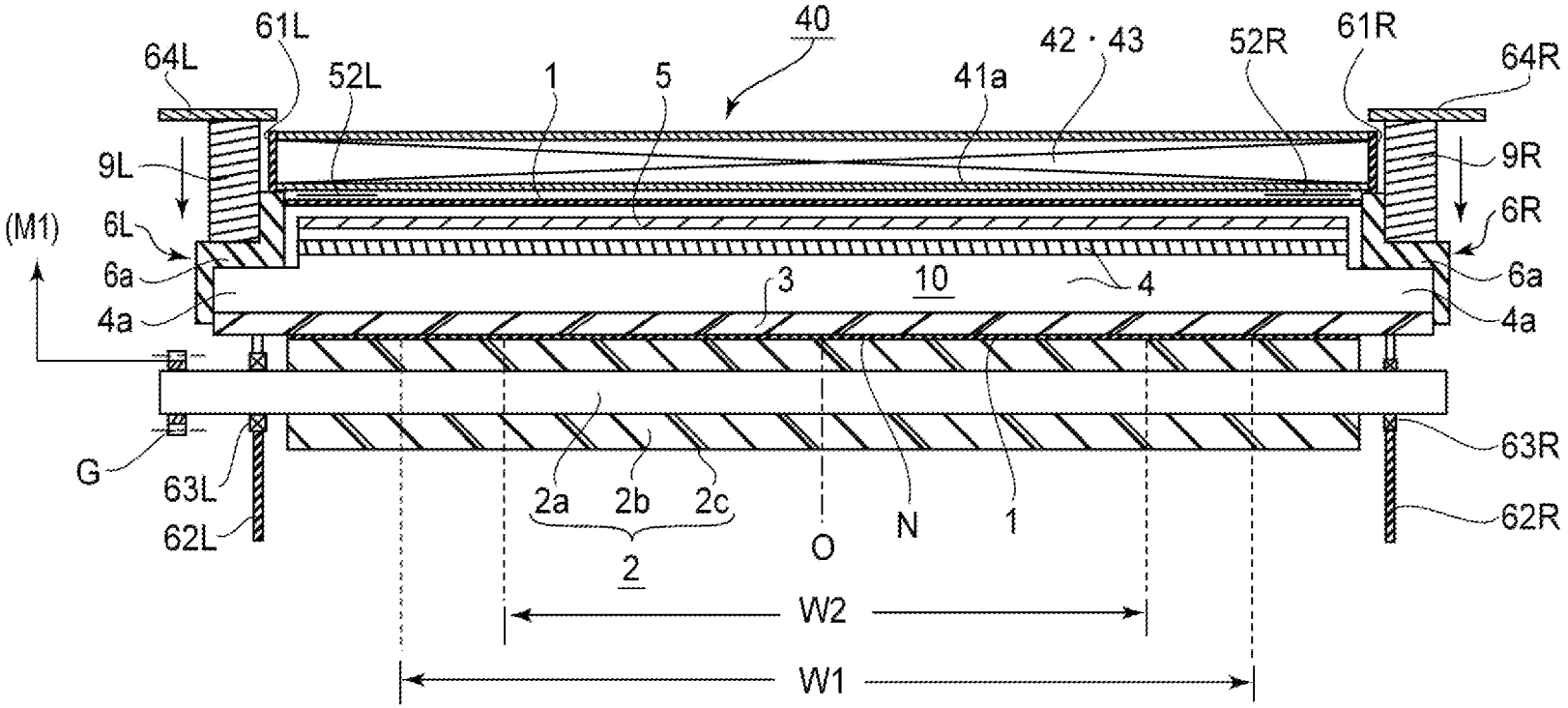
FIG. 4 is a schematic longitudinal front view of the principal part of the fixing device.
Figure 5:
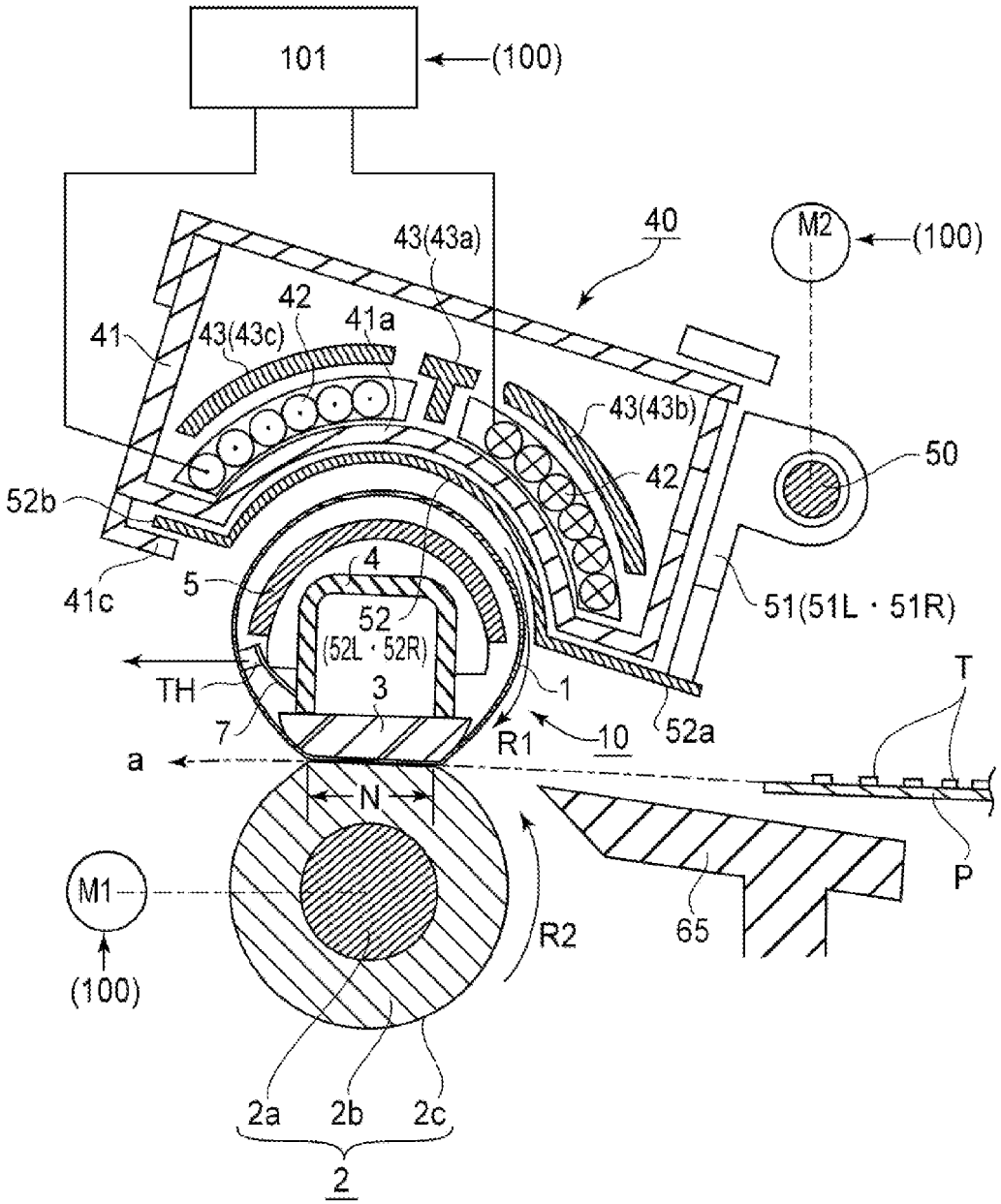
FIG. 5 is an enlarged schematic cross-sectional view of the principal part of the fixing device.
Figure 6:
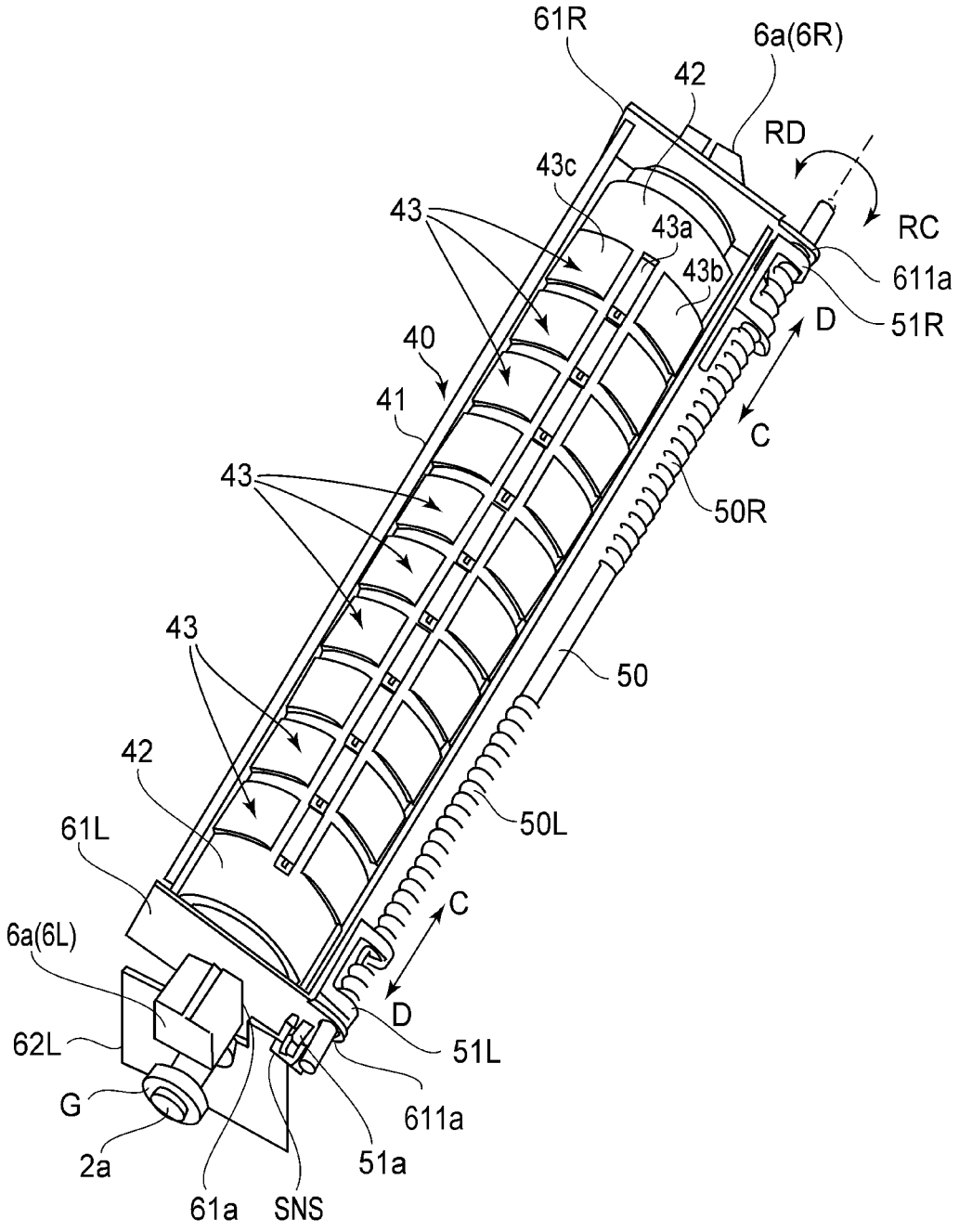
FIG. 6 is a schematic perspective view of the principal part of the fixing device in a state in which an inner portion of a coil unit is shown.

The fixing device A in this embodiment is an image heating apparatus of an external heating type and of the electromagnetic induction heating type. FIG. 3 is a schematic front view of a principal part of the fixing device A and is a block diagram of a control system. FIG. 4 is a schematic longitudinal front view of the principal part of the fixing device A. FIG. 5 is an enlarged schematic cross-sectional view of the principal part of the fixing device A. FIG. 6 is a schematic perspective view of the principal part of the fixing device A in a state in which an inner portion of a coil unit is shown.

This fixing device D roughly includes the following members and means.

a: A heating assembly 10 including a flexible endless belt (hereinafter referred to as a fixing belt or a belt) 1 as a rotatable heating member (rotatable member) contactable to an image carrying surface of the recording material P.

b: An elastic pressing roller as a back-up member (opposing member, pressing member, rotatable pressing member) opposing the belt 1 of the heating assembly 10.

c: A pressing urging member (pressing means) 9 (9L, 9R) for forming a fixing nip (nip) N by pass-contacting the belt 1 and the pressing roller 2 with each other.

d: A coil unit (induction heating device) 40 as a magnetic flux generating means for heating the belt 1.

e: A magnetic flux adjusting member (magnetic flux shielding member, magnetic flux suppressing member) 52 (52L, 52R) and a moving means (driving means) M2, 50, 51 (51L, 51R) for moving the magnetic flux suppressing member.

(1) Heating Assembly 10

The heating assembly 10 includes the rotatable heating member 1 containing a metal layer (magnetic member, electroconductive member) which generates heat by electromagnetic induction when magnetic flux (magnetic field) generated from the coil unit 40, including an exciting coil, described later. In this embodiment, this rotatable heating member 1 is a flexible endless (cylindrical) belt member (endless belt). Further, the rotatable heating member 1 includes a metal-made stay 4 having a downward U-shape in cross section. In a lower side of this stay 4, a pressing pad (nip pad) 3 as a pressure-imparting member is mounted along a longitudinal direction of the stay 4.

The pad 3 is a member for forming the fixing nip N by causing a predetermined pressing (urging) force to act between the belt 1 and the pressing roller 2 and is formed of a heat-resistant resin. The stay 4 is required to have rigidity (stiffness) for applying the pressure to the nip N, and is formed of iron in this embodiment. In an upper side (coil unit 40 side) of the stay 4, an inside magnetic core (magnetic shielding member, magnetic shielding core) 5, having a substantially arcuate shape in cross section, for concentrating the magnetic flux at the belt 1 in order to efficiently induction-heat the belt 1, is provided along the longitudinal direction of the stay 4. This core 5 also prevents a temperature rise due to the induction heating of the metal-made stay 4.

At each of left and right end portions of the stay 4, an extended arm portion 4*a* is provided. The extended arm portions 4*a* project outward from the left and right end portions of the belt 1, respectively. With the left and right arm portions 4*a*, left and right symmetrical flange members 6L and 6R are engaged, respectively. The belt 1 is externally engaged loosely with a composite member of the above-described pad 3, stay 4 and core 5. The left and right flange members 6L and 6R are regulating (limiting) members for regulating (limiting) movement of the belt 1 in the longitudinal direction and a shape of the belt 1 with respect to a circumferential direction.

In the belt 1, as described later, a base layer 1*a* (FIG. 7) is constituted by metal which generates heat by electromagnetic induction heating. For that reason, as described later, as a means for regulating (limiting) lateral movement of the rotating belt 1 in a widthwise direction, the flange members 6L and 6R only for simply receiving end surfaces of the belt 1 may only be required to be provided, so that the constitution of the fixing device A can be simplified.

At a longitudinal central portion of the stay 4, a temperature sensor TH such as a thermistor as a temperature detecting means (temperature detecting element) for detecting a temperature of the belt 1 is provided via an elastic supporting member 7. The sensor TH is elastically contacted to an inner surface of the belt 1 by the supporting member 7. As a result, even when positional fluctuation such as waving of the rotated belt 1 at a sensor contact surface is caused, the sensor TH follows this positional fluctuation, so that a good contact state is maintained.

The above-described belt assembly 10 is provided by engaging pressure-receiving portions 6*a* of the left and right flange members 6L and 6R, between left and right fixed upper side plates 61L and 61R of a fixing device chassis, with vertical guide slit portions 61*a* formed in the side plates 61L and 61R, respectively. Incidentally, a general structure of the chassis was omitted from the figures. Accordingly, the assembly 10 has a degree of freedom such that the assembly 10 is movable in a vertical (up-down) direction along the slit portions 61*a* between the left and right side plates 61L and 61R.

Figure 7:
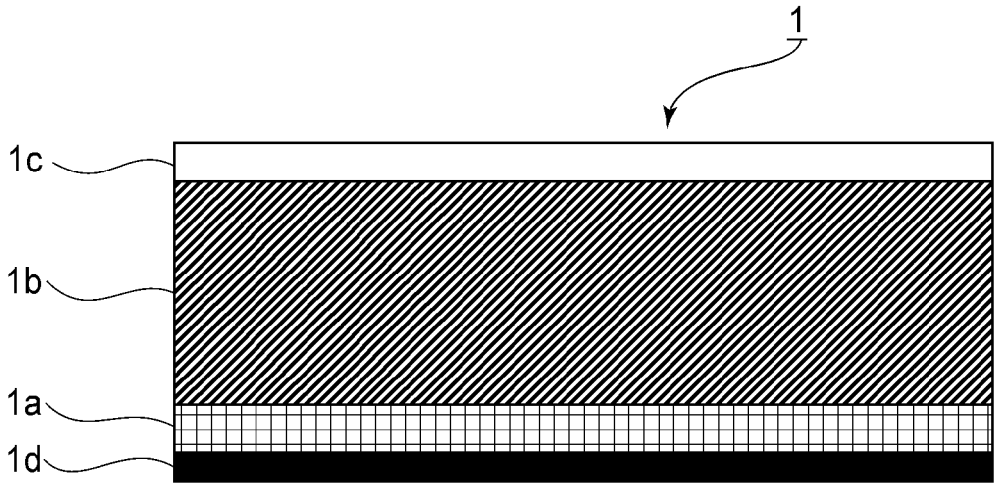
FIG. 7 is a schematic sectional view showing a layer structure of a fixing belt.

FIG. 7 is a schematic view of a layer structure of the belt 1 includes the metal base layer 1*a* of about 20-40 mm in inner diameter. At an outer periphery of the base layer 1*a*, a heat-resistant rubber layer as an elastic layer 1*b* is provided. A thickness of the rubber layer 1*b* may preferably be set in a range of 100-800 μm. In this embodiment, the thickness of the rubber layer 1*b* is set at 1000 μm in consideration of reduction in warming up time by decreasing thermal capacity of the belt 1 and obtaining of a fixing image suitable when a color image is fixed. Further, at an outer periphery of the rubber layer 1*b*, as a surface parting layer 1*c*, a layer of a fluorine-containing resin material (e.g., PFA or PTFE) is provided.

In an inner surface side of the base layer 1*a*, in order to lower sliding friction between the belt inner surface and the temperature sensor TH, a slidable layer 1*d* having a high sliding property may also be provided in a thickness of 10-50 μm. Incidentally, as a material for the metal layer 1*a* of the fixing belt 1, iron alloy, copper, silver, or the like is appropriately selectable.

(2) Pressing Roller 2

The pressing roller (rotatable pressing member or rotatable driving member) 2 is 40 mm in outer diameter, and on a core metal 2*a* formed of metal, a rubber layer as an elastic layer 2*b* is formed, and at a surface thereof, a parting layer 2*c* is provided. The pressing roller 2 is rotatably supported and provided between left and right fixed lower side plates 62L and 62R of the fixing device chassis at left and right end portions of the core metal 2*a* via bearings 63L and 63R. The pressing roller 2 is disposed in parallel to the assembly 10 with respect to the longitudinal direction in a lower side of the heating assembly 10. At a leaf-side end portion of the core metal 2*a*, a pressing roller driving gear G is coaxially and integrally provided.

(3) Pressing Urging Members 9L and 9R

Between the pressure-receiving portions 6*a* of the left and right flange members 6L and 6R of the heating assembly 10 and left and right fixed spring-receiving members 64L and 64R positioned and provided above the flange members 6L and 6R, respectively, left and right stay-pressing (urging) members 9L and 9R as the pressing urging members are compressedly provided.

By predetermined compression reaction forces of the pressing springs 9L and 9R, together with the left and right flange members 6L and 6R of the heating assembly 10, the stay 4 and the pad 3 are equally pressed down in left and right sides. Then, the pad 3 is press-contacted to an upper surface of the pressing roller 2 with a predetermined pressing force against elasticity of the elastic layer 2*b* via the belt 1. By this press contact, between the belt 1 and the pressing roller 2, the fixing nip N having a predetermined width with respect to the recording material conveyance direction a is formed. The pad 3 assists formation of a pressure profile of the nip portion N.

(4) Coil Unit 40

The coil unit 40 is a heating source (induction heating means) for heating the belt 1 by electromagnetic induction, and is fixed and provided between the left and right fixed upper side plates 61L and 61R of the fixing device chassis in the upper side of the heating assembly 10. With respect to the coil unit 40, inside a housing 41 which is long in a left-right direction and which is an electrically insulating resin molded product as a coil holding member, an exciting coil (coil for generating the magnetic flux) 42 and an outer magnetic core 43 are provided.

A bottom plate 41*a* side of the housing 41 is an opposing surface to the outer surface of the belt 1. The bottom plate 41*a* is curved, in cross section, toward the inside of the housing 41 so as to follow an outer peripheral surface of the belt 1 in a substantially upper-half circumferential range. The housing 41 opposes the upper surface of the belt 1 with a predetermined gap (spacing) in the bottom plate 41*a* side, and is fixed and provided between the upper side plates 61L and 61R.

The coil 42 uses Litz wire as electric wire, and is formed in an elongated (ship's) bottom-like shape and is wound so as to oppose an almost peripheral surface of and a part of a side surface of the belt 1. Further, the coil 42 is abutted against the inner surface of the bottom plate 41*a* curved inside the housing 41, thus being accommodated inside the housing 41. To the coil 42, a high-frequency current of 20-60 kHz is applied from a power source unit (or device) (exciting device) 101 controlled by a controller (control circuit portion: control means) 100.

The external (outside) magnetic core 43 is provided to cover the outside of the coil 42 so that the magnetic flux generated by the coil 42 is prevented from being substantially leaked to a portion other than the metal layer (electroconductive layer) 1*a* of the belt 1. The core 43 is, as shown in FIG. 6, provided along the longitudinal direction of the coil 42 and is divided into a plurality of portions which are arranged in parallel with respect to a direction (longitudinal direction of the coil 42) perpendicular to the recording material conveyance direction a, and is constituted so as to surround a winding central portion of the coil 42 and its periphery.

Further, in this embodiment, as shown in FIG. 6, a constitution is employed in which each of individual divided cores of the core 43 divided in the plurality of portions with respect to the direction perpendicular to the recording material conveyance direction a is further divided into 3 portions. That is, the constitution is employed in which the individual divided core is divided into the 3 portions consisting of a central more portion 43*a* corresponding to the winding central portion of the coil 42, and a front-side core portion 43*b* and a rear-side core portion 43*c* in front and rear sides, respectively, the central core portion 43*a*. It is also possible to employ an integral shape of the central core portion 43*a*, the front-side core portion 43*b* and the rear-side core portion 43*c* without dividing the core 43 into the 3 portions.

An upper-side cover plate 61*b* of a housing 61 is provided. FIG. 6 is a schematic perspective view of a principal part of the device A in a state in which the cover plate 61*b* is removed to shown the inside of the coil unit 40 (housing 61).

(5) Magnetic Flux Adjusting Members 52L and 52R and Moving Means 50 and 51

The magnetic flux adjusting members (magnetic flux suppressing members) 52L and 52R are members for reducing the magnetic flux acting from the coil 42 onto the belt 1 in a region where there is the magnetic flux between the coil 42 and the belt 1. That is, the magnetic flux suppressing member is a magnetic flux adjusting means for adjusting the magnetic flux by being moved to an adjusting position where the magnetic flux acting in a non-sheet-passing portion region of the belt 1 when a recording material having a width smaller than a maximum sheet width, of a recording material capable of being passed through the device A, with respect to the widthwise direction perpendicular to the recording material conveyance direction a.

The magnetic flux adjusting members 52L and 52R are movement-controlled, depending on widthwise information of the recording material passed through the device A, by a driving motor M2, a leading screw member (leading member) 50 and slidable member 51 (51L and 51R) as a connecting member, which constitute the moving means (driving means) and which are to be controlled by the controller 100. These magnetic flux adjusting members 52L and 52R, the moving means M2, 50 and 51, and movement control will be specifically described below in (7).

(6) Fixing Operation

In a stand-by state of the image forming apparatus, in the fixing device A, a fixing motor M1 is turned off and thus rotation of the pressing roller 2 is stopped. Electric energy supply to the coil 42 of the coil unit 40 is turned off.

The controller 100 turns on the fixing motor M1 on the basis of input of a print job start signal (image forming job start signal). As a result, a driving force of the fixing motor M1 is transmitted to the pressing roller driving gear G via a drive transmitting mechanism (not shown), so that the pressing roller 2 is rotationally driven in the counterclockwise direction of an arrow R2 in FIG. 5 at a predetermined speed.

By the rotation of the pressing roller 2, a rotational force acts on the belt 1 by a frictional force between the surface of the pressing roller 2 and the surface of the belt 1 at the fixing nip N. The belt 1 is rotated by the rotation of the pressing roller 2 in the clockwise direction of an arrow R1 at the same speed as the rotational speed of the pressing roller 2 around the stay 4, the pad 3 and the core 5 while sliding on the pad 3 in a state in which its inner surface closely contacts the lower surface of the pad 3. Movement of the belt 1 in a thrust direction of the belt 1 with the rotation of the belt 1 is regulated (limited) by flange portions of the left and right flange members 6L and 6R.

The belt 1 is rotated as described above by the rotational drive of the pressing roller 2 through the driving motor M1 controlled by the controller 100 at least during execution of the image formation. This rotation is performed at a peripheral speed substantially equal to a conveyance speed of the recording material P carrying an unfixed toner image T conveyed from the image forming portion side. In this embodiment, a surface rotational speed of the fixing belt 1 is 200 mm/sec and it is possible to fix the full-color image on 50 sheets per minute for A4 size and on 32 sheets per minute for A4R size.

The controller 100 supplies an AC current (high-frequency current) of, e.g., 20 kHz to 60 kHz from the power source unit 101 to the coil 42. The coil 42 generates AC magnetic flux (magnetic field) by the supply of the AC current. The AC current is induced by the core 43 into the metal layer 1*a* of the belt 1 in the upper side of the rotating belt 1. Then, eddy current is generated in the metal layer 1*a*, and by Joule heat due to the eddy current, the metal layer causes self-heat generation (electromagnetic induction heat generation), so that the belt 1 is increased in temperature.

That is, when the rotating belt 1 passes through a region where there is the magnetic flux generated from the unit 40, the metal layer 1*a* generates the heat by electromagnetic induction, so that the belt 1 is heated through full circumference to be increased in temperature. In this embodiment, the belt 1 and the coil 42 of the unit 40 are maintained in an electrically insulated state by a mold (housing bottom plate) 41*a* of about 2 mm in thickness, so that the belt 1 and the coil 42 are disposed with a certain distance, and the belt 1 is uniformly heated.

The temperature of the belt 1 is detected by the temperature sensor TH. The sensor TH detects the temperature of the belt 1 at a portion corresponding to a sheet-passing region, and detected temperature information is fed back to the controller 100. A temperature control functional portion of the controller 100 controls electric power (energy) to be supplied from the power source unit 101 to the coil 42 so that a detected temperature (information on the detected temperature) inputted from the sensor TH is maintained at a predetermined target temperature (fixing temperature: information on a predetermined temperature).

That is, in the case where the detected temperature of the belt 1 is increased to the predetermined temperature, electric energy supply to the coil 42 is interrupted. In this embodiment, temperature adjustment is effected by changing a frequency of the high-frequency current on the basis of a detected value of the sensor TH so that the temperature is kept at a constant temperature of 180° C. which is the target temperature of the belt 1, thus controlling the electric power to be inputted into the coil 42.

In a state in which the roller 2 is driven as described above and the belt 1 is increased in temperature up to the predetermined fixing temperature and is temperature-controlled at the predetermined fixing temperature, the recording material P carrying thereon the unfixed toner image T is guided and introduced by a guide member 65 into the nip N with its toner image carrying surface toward the fixing belt 1. Then, the recording material P is intimately contacted to the outer peripheral surface of the belt 1 in the nip N and is nip-conveyed together with the belt 1 through the nip N.

As a result, the heat of the belt 1 is principally provided to the recording material P and the pressure of the nip N is applied to the recording material P, so that the unfixed toner image T is heat-fixed on the surface of the recording material P. The recording material P passing through the nip N is self-separated (curvature-separated) from the outer peripheral surface of the belt 1 by deformation of the surface of the belt 1 at an exit portion of the nip N, thus being conveyed to the outside of the fixing device A.

The coil unit 40 including the coil 42 is not disposed inside the belt 1 to be heated to the high temperature, but is disposed outside the belt 1 and therefore it is hard for the temperature of the coil 42 to become a high temperature, so that the electric resistance is also not increased, and thus it is possible to alleviate heat loss due to the Joule heat generation even when the high-frequency current is passed through the coil 42. Further, the coil 42 disposed outside the belt 1 also contributes to a small diameter (low thermal capacity) of the belt 1, so that it can be said that the coil 42, consequently, has an excellent energy saving property.

In the fixing device A in this embodiment, as shown in FIG. 5, in a cross section, the coil unit 40 is provided by being inclined toward a recording material entrance of the fixing nip N with respect to the heating assembly 10. As a result, an induction-heated portion of the belt 1 by the coil unit 40 is caused to approach the fixing nip N as close as possible with respect to the rotational direction of the belt 1, so that heat efficiency is improved.

(7) Suppression of Non-(Sheet)-Passing Portion Temperature Rise

As already described above, when a plurality of small-sized recording materials (narrower in width than the maximum size width of the recording material usable in the device) are continuously subjected to fixing (during a continuous job), a so-called non-(sheet)-passing portion temperature rise is generated. A magnetic flux adjusting means multi-size compatible magnetic flux shielding means for controlling a distribution of heat generation of the fixing device A with respect to the longitudinal direction depending on the recording material width size in order to meet the non-passing portion temperature rise will be described.

The conveyance of the recording material P through the fixing device A is made in this embodiment on a so-called center (line) basis so that a widthwise center of the recording material is the same with respect to width sizes of all of the recording materials. In FIGS. 3 and 4, a line O represents a center reference line (phantom line). A width W1 represents the maximum size width of the recording material usable in the device A, and a width W2 represents a minimum size width of the recording material usable in the device A.

In the coil unit 40, a maximum width of the whole of the outside magnetic core 43 which influences a heat generation width of the belt 1 and which is divided into a plurality of portions and disposed with respect to a longitudinal direction is W1 so as to meet the maximum size with W1 of the recording material P.

Further, in this embodiment, as the magnetic flux adjusting means for meeting various width sizes of recording materials (the maximum size width W1 to the minimum size width W2), the magnetic flux adjusting members 52 (52L and 52R) are used. The magnetic flux adjusting member 52 are the magnetic flux shielding members and may also be non-magnetic metal such as aluminum, copper, silver, gold or brass or its alloy or may also be a high-permeability material such as ferrite or permalloy.

The magnetic flux adjusting member 52 is a member for reducing, in a region where there is the magnetic flux between the coil 42 of the coil unit 40 and the belt 1, the magnetic flux acting from the coil 42 toward the belt 1. That is, with respect to the widthwise direction perpendicular to the recording material conveyance direction a, the magnetic flux adjusting member 52 is a magnetic flux adjusting means for adjusting the magnetic flux by being moved to an adjusting position, where the magnetic flux acting in the non-sheet-passing portion region of the belt 1 is to be decreased, when the recording material having a width smaller than the maximum size width of the recording material is subjected to the fixing.

In the device A in this embodiment, the conveying of the recording material P is made on the center (line) basis and therefore the pair of magnetic flux adjusting members 52, i.e., 52L and 52R is disposed in left and right sides of the device A, respectively. With respect to an arrangement position of the magnetic flux adjusting members 52, it would be considered that the magnetic flux suppressing member 52 is disposed between the coil 42 and the outside magnetic core 43, between the coil 42 and the belt 1 or between the belt 1 and the inside magnetic core 5. In this embodiment, a copper plate was used as the magnetic flux adjusting member 52 and was inserted between the coil 42 and the belt 1.

Figure 8:
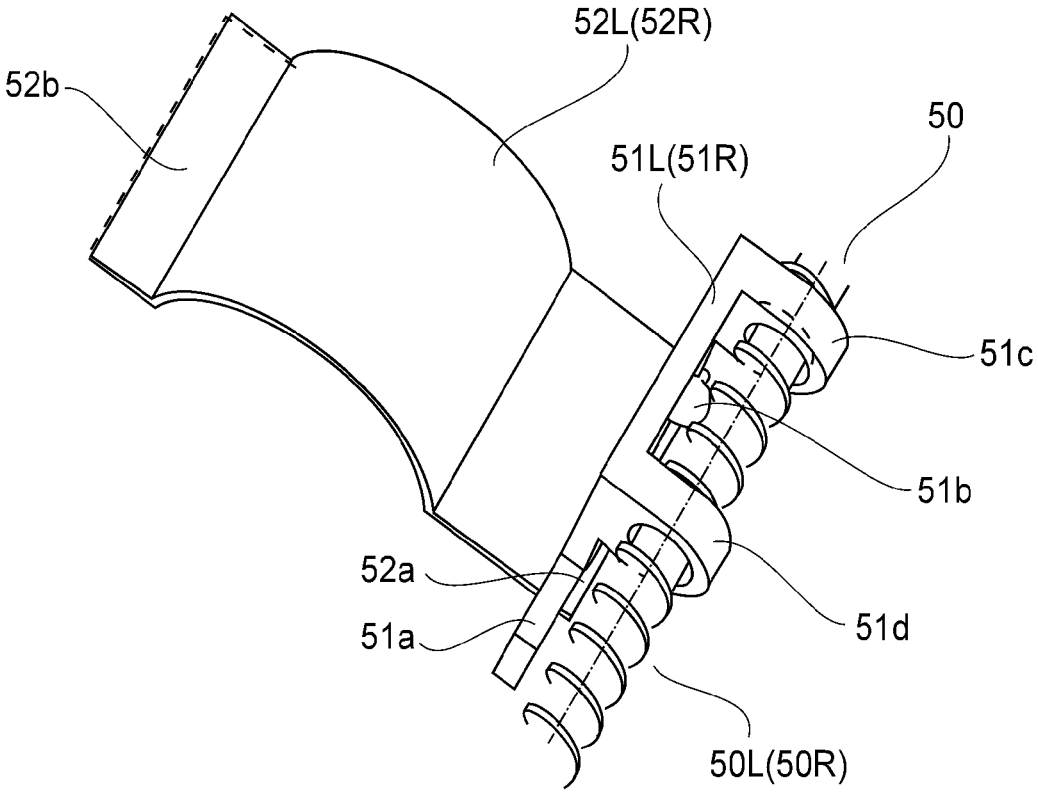
FIG. 8 is a detailed view of a movable portion of the magnetic flux adjusting member.

That is, in the device A in this embodiment, the pair of magnetic flux adjusting members 52 (52L and 52R) is disposed in the left and right sides of the belt 1 in a gap formed between the coil unit 40 and the belt 1. As shown in FIGS. 5 and 8, each of the magnetic flux adjusting members 52L and 52R is a member processed by bonding a band plate-like copper plate in a substantially arcuate shape so as to follow a substantially half-circumferential range of the outer peripheral surface of the belt 1. By the insertion of the magnetic flux adjusting members 52L and 52R, there is an effect of weakening passing of the magnetic flux, formed by the coil 42 and the outside magnetic core 43, through the heat generating layer 1*a* of the belt 1.

The left and right magnetic flux adjusting members 52L and 52R are subjected to positional movement control with respect to the longitudinal direction (left-right direction) of the device A by the moving means. That is, the magnetic flux adjusting members 52L and 52R are movement-controlled between an initial position (retracted position or home position) and the adjusting position (effective position). The initial position is a position which is not located in the region where there is the magnetic flux. The adjusting position is a position for permitting a lowering of temperature in the non-passing portion region of the belt 1 when the small-sized recording material having the width smaller than the maximum width of a large-size recording material usable in the device A is passed through the device A.

By moving the magnetic flux adjusting members 52L and 52R in the longitudinal direction of the device A, a distribution of longitudinal heat generation depending on the width size of the recording material P to be passed through the device A is controlled.

A longitudinal width 52W (FIG. 1: width with respect to the direction crossing the recording paper conveyance direction) of each of the left and right magnetic flux adjusting members 52L and 52R is not more than a width in which the magnetic flux suppressing member 52L (52R) is able to be disposed at a differential position located between the left (right) fixed upper side plate 61L (61R) of the fixing device chassis and an inner diameter portion longitudinal end of the coil 42. This is based on three reasons, i.e., a sufficient width is provided, in which a magnetic flux shielding effect is achieved, the maximum heat generation width W1 corresponding to a maximum size width of the recording material is not decreased, and the magnetic flux suppressing member 52 can be disposed without enlarging the longitudinal width of the fixing device A.

In order to sufficiently achieve the magnetic flux shielding effect, with respect to the width in the direction crossing the recording material conveyance direction a, a relationship between a longitudinal width 52W of the magnetic flux adjusting members 52L and 52R and a longitudinal width 43W of the outside magnetic core 43 which is divided is 52W>43W. There is because when this condition is not satisfied, i.e., when the width 52W is smaller than the width 43W, a reducing effect of a degree of the recording material end portion temperature rise becomes small, and therefore the width 52W is set (defined) so as to be larger than the width 43W of the outside magnetic core 43 which is divided.

Figure 1:
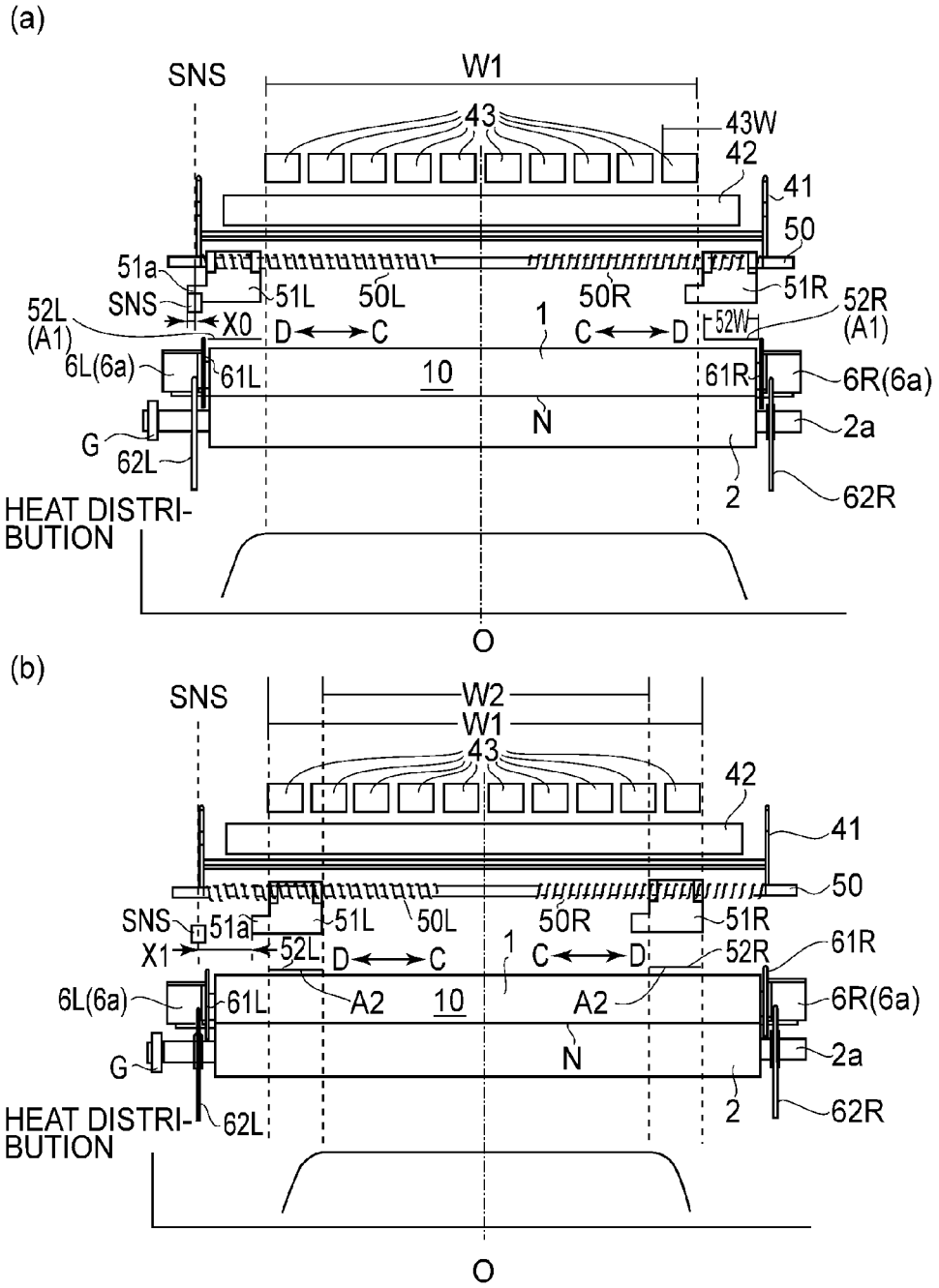

Parts (a) and (b) of FIG. 1 are exploded views of constituent members of the fixing device A, wherein (a) shows a state in which each of the left and right magnetic flux adjusting members 52L and 52R is located at an initial position A1, and (b) shows a state in which each of the left and right magnetic flux adjusting members 52L and 52R is moved to an adjusting position A2 corresponding to a position during the fixing of the recording material having the minimum size width W2.

Each of the left and right magnetic flux adjusting members 52L and 52R is, as shown in (a) of FIG. 1, disposed outside the region of the maximum size width W1 of the recording material to ensure the heat generation distribution corresponding to the maximum size width W1. This position is the initial position A1. The initial position A1 of each of the magnetic flux adjusting members 52L and 52R is deviated from the region in which there is the magnetic flux between the coil 42 and the belt 1.

During the film of the recording material having the minimum size width W2, the left and right magnetic flux adjusting members 52L and 52R are moved in an arrow direction C from the initial position A1 shown in (a) of FIG. 1 to the adjusting position A2 shown in (b) of FIG. 1. In (b) of FIG. 1, the magnetic flux adjusting members 52L and 52R are inserted into end portions outside the heat generation width W1 formed by the magnetic flux shielding outside magnetic core 43 which is divided, whereby the magnetic flux passed through the belt 1 is weakened and thus the heat generation distribution corresponding to the minimum size width W2 of the recording material is formed.

Next, the moving means for the magnetic flux adjusting members 52L and 52R will be described. As shown in FIG. 5, the magnetic flux adjusting members 52L and 52R are disposed between the belt 1 and the coil 42 and are held, in a base portion side 52*a* by slidable members 51L and 51R movable in the longitudinal direction of the device A. The magnetic flux adjusting members 52L and 52R are held by the slidable members 51L and 51R so that the magnetic flux suppressing members 52L and 52R to be moved in the longitudinal direction of the device A and the rotating belt 1 do not contact each other.

In this embodiment, by providing the housing 41 of the coil unit 40 with a stopper member 41*c* for receiving a free end portion 52*b* of each of the magnetic flux adjusting members 52L and 52R, whereby the magnetic flux adjusting members 52L and 52R are prevented from contacting the belt 1.

As a holding method of the magnetic flux adjusting members 52L and 52R, a constitution in which the slidable members 51L and 51R and the magnetic flux adjusting members 52L and 52R are integral with each other and a constitution in which the magnetic flux adjusting members 52 are contacted to the housing 41 in order to ensure a clearance from the belt 1 may also be employed. The present invention does not define a holding method of the slidable members 51 and the magnetic flux adjusting members 52. The slidable members 51L and 51R which hold the magnetic flux adjusting members 52L and 52R are disposed symmetrically at longitudinal end portions of the device A with respect to a center reference line O of the conveyance of the recording material P.

Between the left and right fixed upper side plates 61L and 61R of the fixing device chassis, in a front side of the coil unit 40, a leading screw member 50 is arranged in parallel to the housing 41 and is disposed while being rotatably supported by bearings 611*a* of the plates 61L and 61R (FIGS. 3 and 6). This leading screw member 50 includes a screw portion 50L in a left-half side and a screw portion 50R in a right-half side, which are screws opposite in helical direction to each other. The bearings 611*a* may also be durable bearing members provided separately.

The left and right slidable members 51L and 51R are threadably mounted on the left-side screw portion 50L and the right-side screw portion 50R, respectively, of the leading screw member 50. The left and right slidable members 51L and 51R which hold the left and right magnetic flux adjusting members 52L and 52R are supplied with a driving force from the leading screw member 50 to be moved in a line-symmetrical manner with respect to the center reference line O of the sheet passing of the recording material P.

The leading screw member 50 is rotationally driven in a normal rotational direction RC shown in FIG. 6, so that the left and right slidable members 51L and 51R are moved in an arrow C direction. On the other hand, the leading screw member 50 is rotationally driven in a reverse rotation direction RD, so that the left and right slidable members 51L and 51R are moved in an arrow D direction.

As shown in FIG. 8, each of the left and right screw portions 50L and 50R of the leading screw member 50 is externally engaged with cylindrical portions 51*c* and 51*d* of the left and right slidable member 51L or 51R, so that a boss portion 51*b* is engaged with the screw portion 50L or 50R. Here, the cylindrical portions 51*c* and 51*d* externally engaged with the screw portion 50L or 50R may also have a shape such that they contact the screw portion 50L or 50R at three or more points so as to reduce a contact portion area with the screw portion 50L or 50R.

The leading screw member 50 is subjected to rotational drive control in the normal rotational direction RC or the reverse rotational direction RD by transmitting, thereto via a drive transmitting mechanism (not shown), a normal rotational force or a reverse rotational force of a driving motor (e.g., stepping motor) M2 controlled by the controller 100.

In a state in which the left and right magnetic flux adjusting members 52L and 52R are located at the initial position A1 of (a) of FIG. 1, when the leading screw member 50 is normally rotated and driven, each of the left and right magnetic flux adjusting members 52L and 52R is moved toward a central portion of the belt 1 with the same movement amount. That is, a spacing between the left and right magnetic flux adjusting members 52L and 52R is narrowed on the center reference line basis.

By controlling the normal rotational amount of the leading screw member 50, the left and right magnetic flux adjusting members 52L and 52R are moved to the adjusting positions A2 for permitting lowering of the temperature at the non-passing portions when the small-sized recording material having a width smaller than the maximum width W1 of the large-sized recording material capable of being passed through the device A is subjected to the fixing. Each of the adjusting positions A2 is a different position corresponding to each of various widths of the small-sized recording materials.

Further, in a state in which the spacing between the left and right magnetic flux adjusting members 52L and 52R is narrowed, when the leading screw member 50 is reversely rotated and driven the left and right magnetic flux adjusting members 52L and 52R are moved toward the initial positions A1 in the left and right end portion sides of the belt 1 with the same movement amount. That is, the spacing between the magnetic flux adjusting members 52L and 52R is broadened.

The above-described motor M2, the leading screw member 50, and the slidable members 51L and 51R constitute the moving means (driving means or shift mechanism) for causing the left and right magnetic flux adjusting members 52L and 52R to perform a reciprocation movement operation between the initial position A1 and the adjusting position A2.

In this embodiment, as the moving means for moving the magnetic flux adjusting members 52L and 52R in the longitudinal direction of the device A, the slidable members 51L and 51R and the leading screw member 50 are used but the moving mechanism is not limited thereto. It is also possible to employ a moving means using a wire so long as the moving mechanism has a movement constitution in which the magnetic flux adjusting members 52L and 52R are symmetrically moved toward the longitudinal end portions with respect to the center reference line O of the conveyance of the recording material P.

Next, control of an operation of the magnetic flux adjusting members 52L and 52R with respect to various paper sizes (W1 to W2) will be described.

As shown in FIGS. 1 and 3, as a control means of the operation of the magnetic flux adjusting members 52 (52L and 52R), the driving motor M2 for driving the leading screw member 50 is provided, and as a position detecting means of the magnetic flux adjusting members 52, a sensor SNS is provided. Further, the controller 100 for controlling an operation of the driving motor M2 on the basis of a signal of the sensor SNS is provided.

The sensor SNS is a photo-interruptor and effects ON and OFF of light blocking by a flag portion 51*a* provided on the left-side slidable member 51L. In view of variation in drive, such as backlash, to be transmitted from the driving motor M2 to the leading screw member 50, an edge of the flag portion 51*a* is detected by the sensor SNS, and then positional control of the magnetic flux adjusting member 52 is effected.

The controller 100 reads a signal of an operating portion 102 (FIG. 3) provided on the image forming apparatus and a signal (information on a size width of the recording material to be used in the device A) of a recording material size inputting means 104 of an external host device 103 such as a computer. Then, on the basis of the signals and the signal of the sensor SNS. The controller 100 controls the driving motor M2.

Figure 9:
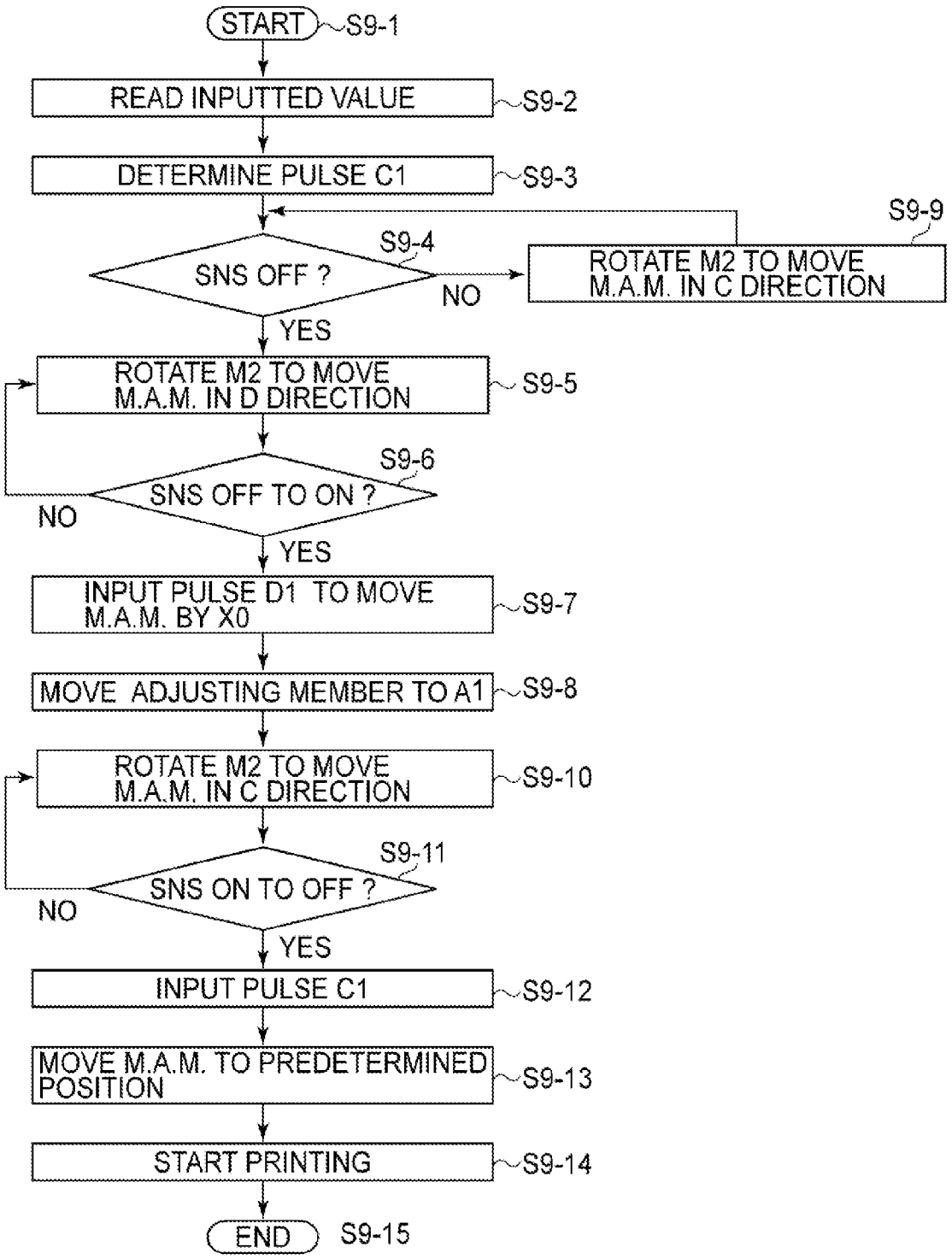
FIG. 9 is a flowchart of movement control of the magnetic flux adjusting member during sheet passing of a recording material.

FIG. 9 is a flowchart of operation control of the magnetic flux adjusting members 52L and 52R in this embodiment. With reference to FIG. 9, an operation of the slidable members 51 (51L and 51R) for holding the magnetic flux adjusting members 52 (52L and 52R) will be described by taking, as an example, the case where the size width of the recording material P to be used in the device A is the minimum size width W2. In this embodiment, the controller 100 controls various devices so that the respective devices operate along steps in this flowchart.

When a print job is started (S9-1), the controller 100 reads an input value of the recording material size from the recording material size inputting means 104 (S9-2). Correspondingly to the input value of the recording material size, by computation of the controller 100, a pulse number C1 to be inputted into the driving motor M2 at the initial position A1 ((a) of FIG. 1) of the magnetic flux adjusting member 52 is determined (S9-3).

The controller 100 reads the signal of the sensor SNS (S9-4), and depending on an ON/OFF state of the sensor SNS, returns the magnetic flux adjusting member (magnetic flux adjusting means ("M.A.M.")) 52 to the initial position A1 shown in (a) of FIG. 1 by using the driving motor M2 and sensor SNS.

First, when the sensor SNS is in an OFF state, the magnetic flux adjusting member 52 is not located at the initial position A1 but is shifted toward a central side with respect to a direction perpendicular to the recording material conveyance direction a, and therefore the magnetic flux adjusting member 52 is moved to the position shown in (a) of FIG. 1 (S9-5).

By reversely rotating and driving the driving motor M2, the magnetic flux adjusting member 52 is moved in an arrow D direction. Passing (sensor SNS signal changed from OFF to ON) of the flag 51*a*, provided on the slidable member 51, through a detection position of the sensor SNS is detected (S9-6). After the detection, a recording paper pulse D1 is inputted into the driving motor M2. As a result, at a position to which the magnetic flux suppressing member 52 is moved by X0, an operation of the magnetic flux adjusting member 52 is ended (S9-7), and the magnetic flux adjusting member 52 is moved to the initial position A1 (S9-8).

On the other hand, when the signal of the sensor SNS is an ON state, the driving motor M2 is normally rotated and driven so that the magnetic flux adjusting member 52 is moved in an arrow C direction (S9-9). Then, when switching (ON to OFF) of the signal of the sensor SNS is recognized (S9-4), the driving motor M2 is reversely rotated and driven, so that the magnetic flux adjusting member 52 is moved in the D direction (S9-5).

Thereafter, the flag portion 51*a* provided on the slidable member 51 passes through the detection position of the sensor SNS (i.e., the sensor SNS signal is changed from OFF to ON) (S9-6), and then the predetermined pulse D1 is inputted into the driving motor M2 (S9-7). As a result, at the position to which the magnetic flux adjusting member 52 is moved by X0, the operation of the magnetic flux suppressing member 52 is ended, and then the magnetic flux suppressing member 52 is moved to the initial position A1 (S9-8).

By rotating the driving motor M2, the magnetic flux adjusting member 52 is moved in an arrow D direction (S9-10). Passing (sensor SNS signal changed from ON to OFF) of the flag 51*a*, provided on the slidable member 51, through a detection position of the sensor SNS is detected (S9-11). After the detection, a recording paper pulse C1 is inputted into the driving motor M2 (M9-12). As a result, at a position to which the magnetic flux adjusting member 52 is moved by X1 shown in (b) of FIG. 1, an operation of the magnetic flux suppressing member 52 is ended (S9-13), and printing is started (S9-14). Then, the control operation of the magnetic flux adjusting member is ended (S9-15).

As a result, during the fixing of the recording material corresponding to the minimum size width W2, it is possible to form a heat generation distribution such that non-passing portion temperature rise and end portion improper fixing are not induced.

Further, when the recording material size is the maximum size width W1, the pulse C1 to be inputted into the driving motor M2 is zero, and then the printing is started without moving the magnetic flux adjusting member 52 from the initial position A1.

Further, with respect to recording material, having a longitudinal width W (W1>W>W2), to be introduced into the fixing device A, the following operation is performed. That is, correspondingly to the input value of the longitudinal width W of the recording material, by computation of the controller 100, the recording paper pulse number C1 from the sensor SNS to be inputted into the driving motor M2 is changed. As a result, similarly as described above, it is possible to form the heat generation distribution, corresponding to the longitudinal width W of the recording material, without inducing the non-sheet-passing portion temperature rise and the end portion improper fixing.

The above-described control is summarized as follows. The controller 100 executes, during a heating job in which the recording material is introduced into and fixed by the fixing device A, control such that the moving means (M2, 50 and 51) is controlled to move the magnetic flux adjusting members 52L and 52R to the adjusting positions A2 depending on information on the size width of the recording material P to be introduced into the fixing device A.

(8) Control of Driving Motor M2

When a control operation for moving, as described above, the magnetic flux adjusting members 52L and 52R to the adjusting positions A2 corresponding to information on the size width of the recording material P to be introduced into the fixing device A is performed, the number of operations of the driving motor M2 is increased, so that an amount of movement of the magnetic flux adjusting members 52L and 52R becomes large. As a result, a load exerted on the motor M2 is increased, so that the motor M2 causes self-temperature rise. For example, in the case where continuous image formation of recording materials (sheets) different in width size is effected in the order of, e.g., A4-sized sheet, A5-sized sheet and A4-sized sheet (printing on mixed sheets), the amount of the movement of the magnetic flux adjusting members 52L and 52R is increased, so that the self-temperature rise of the motor M2 can be caused to occur.

In the motor M2 (stepping motor) in this embodiment, in order satisfy the temperature rise, it is preferable that an average current (ampere) is suppressed at a level of not more than 0.14 A. Incidentally, in the case where productivity lowering control described below is not executed, the average current of 0.31 A was applied. Therefore, in order to suppress the average current at the level of not more than 0.14 A, the productivity lowering control shown in FIG. 10 was effected.

Here, N represents the number of occurrences (times) of drive of the motor per unit period, and PPM represents the number of sheets of the recording material conveyed (supplied) per minute, i.e., productivity. In this embodiment, a current flowing with one full turn of drive of the driving motor M2 is 0.7 A. In this case, a total of the current flowing for 1 minute is 0.7 N (A), and therefore an average current (ampere) X per minute is represented by X=0.7 N/60 (A).

In the case where the controller 100 calculates the average current X and then discriminates that X is 0.14 A or less, the productivity is maintained or enhanced. Further, in the case where the controller 100 discriminates that X is larger than 0.14 A, the controller 100 lowers the productivity by increasing a feeding (conveyance) interval (supplying interval) between the recording material and a subsequent recording material in order to provide X=0.14 A.

Incidentally, in this embodiment, the average current N satisfying both of (i) X=0.7 N/60 and (ii) X<0.14 (A) is N<12. That is, in this embodiment, the self-temperature rise of the motor M2 is suppressed when the number of occurrences of drive per (one) minute (i.e., the number of times per unit time in which the magnetic flux adjusting member is moved by the motor M2) is not more than a predetermined value (12 times in this embodiment).

Figure 11:
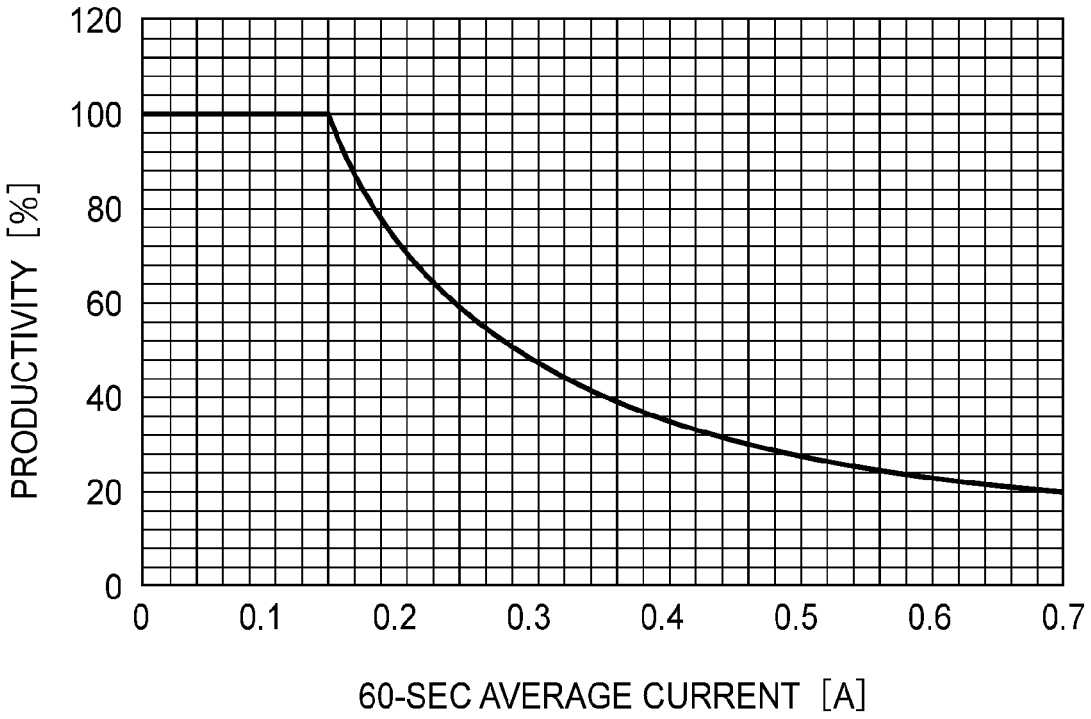
FIG. 11 is a graph showing a percentage of a lowering in productivity relative to an average current value.

That is, the controller 100 effects, from after start of printing, sampling of the current 60 times at an interval of 1 second. The controller 100 derives the average current, applied for 1 minutes, by computation. Then, in the case where the average current is 0.14 A or more, the controller 100 performs a process of increasing an interval (sheet interval) of the recording materials P to be introduced into the fixing device A so that the average current falls in a range of 0.14 A or less, thus lowering the productivity (FIG. 11).

In a sampling and computing method, first to 60-th storing regions are provided and computation is effected but an interval of 1 second by successively writing data in the storing regions from the first storing region in which first sampling information is to be stored. At the time when the sampling information is written in the 60-th storing region, subsequent sampling information is overwritten in the first storing region to perform loop processing, so that it becomes possible to perform linear computation.

The above-described control is summarized as follows. The controller 100 makes, during the continuous job in which the recording materials P are continuously introduced into and heated by the fixing device A, sampling of the value of the current, applied to the driving motor M2 in a certain time, on the basis of a soft signal, and then records the current value. Thereafter, the controller 100 computes an average current value of the recorded current values. Then, the controller 100 effects control in which the supplying interval of the recording materials to be continuously introduced into the fixing device is increased so that the average current value falls within a range of not more than a predetermined control current value. As a result, in the case where the printing of the mixed sheets is performed, the average current value of the driving motor M2 is caused to fall within the range of not more than the predetermined control current value, so that it is possible to prevent the self-temperature rise of the driving motor M2 by a simple constitution without providing a temperature detecting means or the like.

Further, with respect to the above-described sampling, by providing one or more storing region and then by overwriting the oldest recorded value, it becomes possible to perform the linear computation of the average current value.

Incidentally, in this embodiment, a constitution in which the recording material feeding interval (supplying interval) is controlled depending on the average value of the current flowing into the driving motor is employed, but the present invention is not intended to be limited to this constitution. It is also possible to employ a constitution in which the recording material feeding interval (supplying interval is controlled depending on a total of values of the current flowing into the slidable member in a predetermined period. Or, it is further possible to employ a constitution in which the recording material feeding interval (supplying interval) is controlled depending on the number of times per predetermined period of drive of the driving motor.

Embodiment 2

Embodiment 2 is characterized in that with respect to the fixing device in Embodiment 1, the controller 100 variably controls, every predetermined time, the feeding interval (supplying interval) of the recording materials to be continuously introduced into the fixing device so that the above-described average current value falls within the range of the above-described predetermined control current value. With respect to the image forming apparatus and the fixing device A in Embodiment 1, constitutions and operations of common portions in this embodiment will be omitted from description.

Figure 10:
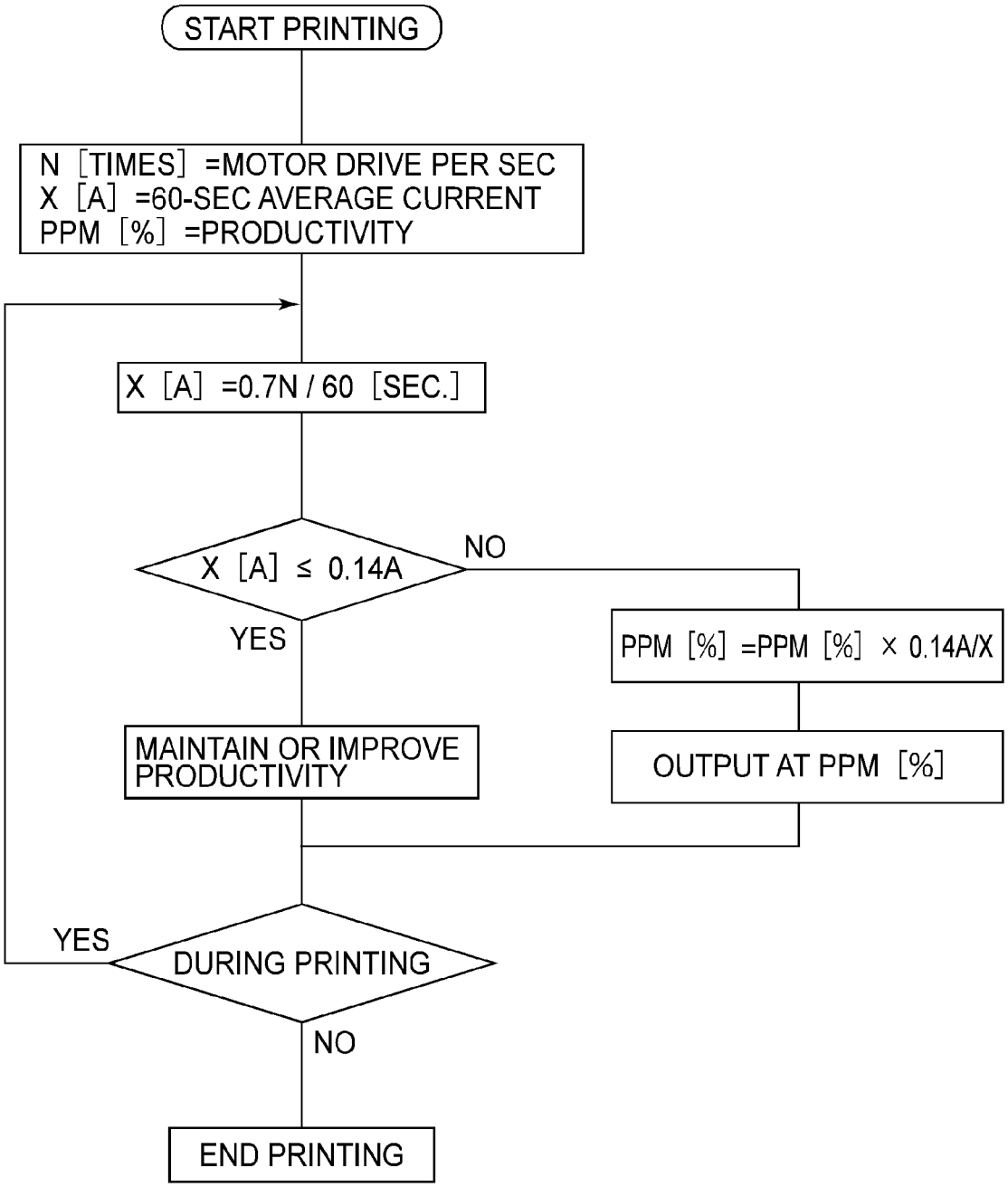
FIG. 10 is a flowchart of control in Embodiment 1.

By effecting the control shown in FIG. 10 to perform the linear computation, it is possible to variably control the sheet feeding interval. As an example, it is possible to cite the case of the continuous job (printing of the mixed sheets) in which the recording materials different in width size are continuously subjected to the image formation in the order of A4-sized sheet, A5-sized sheet, A4-sized sheet, . . . , and the A4-sized sheet, i.e., the case where the width size of the recording materials is different at only an initial stage. In such a case, the amount of movement of the magnetic flux adjusting members 52L and 52R is zero during continuous fixing of the image on the large number of the A4-sized sheets in a later stage of the job. For that reason, similarly as in Embodiment 1, the motor control is effected, and then at the time when the current value falls within the range of not more than the threshold of 0.14 A, the feeding interval of the A4-sized sheet is returned to the feeding interval in a normal state, so that it becomes possible to enhance the productivity (FIG. 11).

Other Embodiments

1) The belt member as the rotatable heating member 1 can also be formed in an endless belt member, having flexibility, which is extended and stretched around a plurality of stretching members and which is circulated and moved by the driving roller. The rotatable heating member 1 can also be formed in a roller member.

2) It is also possible to employ a device constitution of an internal heating type in which the coil unit 40 is provided inside the rotatable heating member 1.

3) The back-up member 2 for forming the nip N with the rotatable heating member 1 is not limited to a roller member. It is also possible to employ a rotatable endless belt member. Further, it is also possible to use the back-up member 2 in the form of a non-rotatable member (pressing pad or the like) having a small friction coefficient at a surface (contact surface with the rotatable heating member 1 or the recording material P). It is also possible to employ a constitution in which also the back-up member 2 is heated.

4) The introduction (conveyance) of the recording material P through the device A is not limited to be effected on the center (line) basis. It is also possible to employ a device constitution in which one-side basis in which the introduction (conveyance) is made on the basis of one-side edge portion of the recording material with respect to the widthwise direction.

5) The use of the fixing device (fixing portion) is not limited to the use as a device for heat-fixing, as a fixed image, the unfixed toner image formed on the recording material as in the above-described embodiments. The fixing device is also effective as a device, for adjusting a surface property of an image, such that the glossiness of the image is improved by heating and pressing again the toner image (fixed toner image or temporarily fixed toner image) which is once fixed or temporarily fixed on the recording material. Such a device is also included in the fixing device (fixing portion) in the present invention.

6) The type of the image forming portions of the image forming apparatus is not limited to the electrophotographic type. The image forming portions may also be of an electrostatic recording type or a magnetic recording type. Further, the type of the image forming portions is not limited to the transfer type but may also employ a constitution in which the unfixed toner image is formed on the recording material by a direct type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 169519/2012 filed Jul. 31, 2012 which is hereby incorporated by reference.

What is claimed is:

1. An image forming apparatus comprising:

(i) an image forming portion configured to form a toner image on a sheet;

(ii) a fixing portion configured to fix the toner image, formed by said image forming portion, on the sheet by heat and pressure, wherein said fixing portion comprises:

(ii-i) a rotatable member;

(ii-ii) an exciting coil configured to cause said rotatable member to generate heat by electromagnetic induction heating;

(ii-iii) a magnetic flux suppressing member configured to suppress a part of magnetic flux acting from said exciting coil to said rotatable member; and (ii-iv) a motor configured to move said magnetic flux suppressing member depending on a width size of the sheet; and (iii) a controller configured to control a feeding operation of the sheet toward said fixing portion when continuous image formation of a plurality of sheets including sheets having a plurality of width sizes is effected, wherein said controller sets a feeding interval of the sheets toward said fixing portion at a first feeding interval, when a number of times of movement per unit time of said magnetic flux suppressing member is estimated to be not more than a predetermined number during the continuous image formation, and wherein said controller sets the feeding interval at a second feeding interval which is longer than the first feeding interval, when the number of times of movement per unit time of said magnetic flux suppressing member is estimated to be more than the predetermined number during the continuous image formation.

2. The image forming apparatus according to claim 1, wherein said exciting coil is provided outside said rotatable member so as to oppose said rotatable member, and wherein said magnetic flux suppressing member is movable between said rotatable member and said exciting coil.

3. The image forming apparatus according to claim 2, wherein said motor moves said magnetic flux suppressing member along a longitudinal direction of said rotatable member.

4. The image forming apparatus according to claim 1, wherein said magnetic flux suppressing member is movable between said rotatable member and said exciting coil, and wherein said motor moves said magnetic flux suppressing member along a longitudinal direction of said rotatable member.

5. The image forming apparatus according to claim 1, wherein said motor moves said magnetic flux suppressing member along a longitudinal direction of said rotatable member.

6. The image forming apparatus according to claim 1, wherein said rotatable member is an endless belt, and wherein said fixing portion includes a rotatable driving member configured to form a nip between said rotatable driving member and said endless belt and for rotationally driving said endless belt.

7. The image forming apparatus according to claim 1, wherein said controller controls the feeding interval of the sheets toward said fixing portion during the continuous image formation, irrespective of the temperature of said rotatable member.

8. An image forming apparatus comprising:

(i) an image forming portion configured to form a toner image on the sheet;

(ii) a fixing portion configured to fix the toner image, formed by said image forming portion, on the sheet by heat and pressure, wherein said fixing portion comprises:

(ii-i) a rotatable member;

(ii-ii) an exciting coil configured to cause said rotatable member to generate heat by electromagnetic induction heating;

(ii-iii) a magnetic flux suppressing member configured to suppress a part of magnetic flux acting from said exciting coil to said rotatable member; and (ii-iv) a motor configured to move said magnetic flux suppressing member depending on a width size of the sheet; and (iii) a controller configured to control a feeding operation of the sheet toward said fixing portion when continuous image formation of a plurality of sheets including sheets having a plurality of width sizes is effected, wherein said controller sets a feeding interval of the sheets toward said fixing portion at a first feeding interval, when the current value per unit time supplied to said motor is estimated to be not more than a predetermined current value during continuous image formation, and wherein said controller sets the feeding interval at a second feeding interval which is longer than the first feeding interval, when the current value per unit time supplied to said motor is estimated to be more than the predetermined current value during continuous image formation.

9. The image forming apparatus according to claim 8, wherein said exciting coil is provided outside said rotatable member so as to oppose said rotatable member, and wherein said magnetic flux suppressing member is movable between said rotatable member and said exciting coil.

10. The image forming apparatus according to claim 9, wherein said motor moves said magnetic flux suppressing member along a longitudinal direction of said rotatable member.

11. The image forming apparatus according to claim 8, wherein said magnetic flux suppressing member is movable between said rotatable member and said exciting coil, and wherein said motor moves said magnetic flux suppressing member along a longitudinal direction of said rotatable member.

12. The image forming apparatus according to claim 8, wherein said motor moves said magnetic flux suppressing member along a longitudinal direction of said rotatable member.

13. The image forming apparatus according to claim 8, wherein said rotatable member is an endless belt, and wherein said fixing portion includes a rotatable driving member configured to form forming a nip between said rotatable driving member and said endless belt and for rotationally driving said endless belt.

14. The image forming apparatus according to claim 8, wherein said controller controls the feeding interval of the sheets toward said fixing portion during the continuous image formation, irrespective of the temperature of said rotatable member.

* * * * *